United States Patent [19]

Jablonski

[11] Patent Number: 4,667,560

[45] Date of Patent: May 26, 1987

[54] MUTE FOR STRING MUSICAL INSTRUMENT

[76] Inventor: Vincent Jablonski, 500 Park Blvd. South, Venice, Fla. 33595

[21] Appl. No.: 838,589

[22] Filed: Mar. 11, 1986

[51] Int. Cl.[4] ..... G10D 3/04

[52] U.S. Cl. ..... 84/310

[58] Field of Search ..... 84/310, 311

[56] References Cited

U.S. PATENT DOCUMENTS 2,175,007 10/1939 Warner ..... 84/311

2,475,055 7/1949 Schuh ..... 84/310

2,483,268 9/1949 Fawick ..... 84/310

4,449,438 5/1984 Goldner ..... 84/310

*Primary Examiner*—Lawrence R. Franklin

*Attorney, Agent, or Firm*—Hauke and Patalidis

[57] ABSTRACT

A mute made of a block of sound-deadening thermoplastic elastomer having a longitudinal slot for placing over the top edge and portions of the surface of a string musical instrument bridge. Cut-out portions are provided forming slots for passage over the strings, the end of the cut-out portions or slots following generally the contour of the top edge of the bridge. The mute dampens the bridge vibrations and deadens the sound transmitted from the strings to the musical instrument soundboard via the bridge.

8 Claims, 6 Drawing Figures

FIG. 1
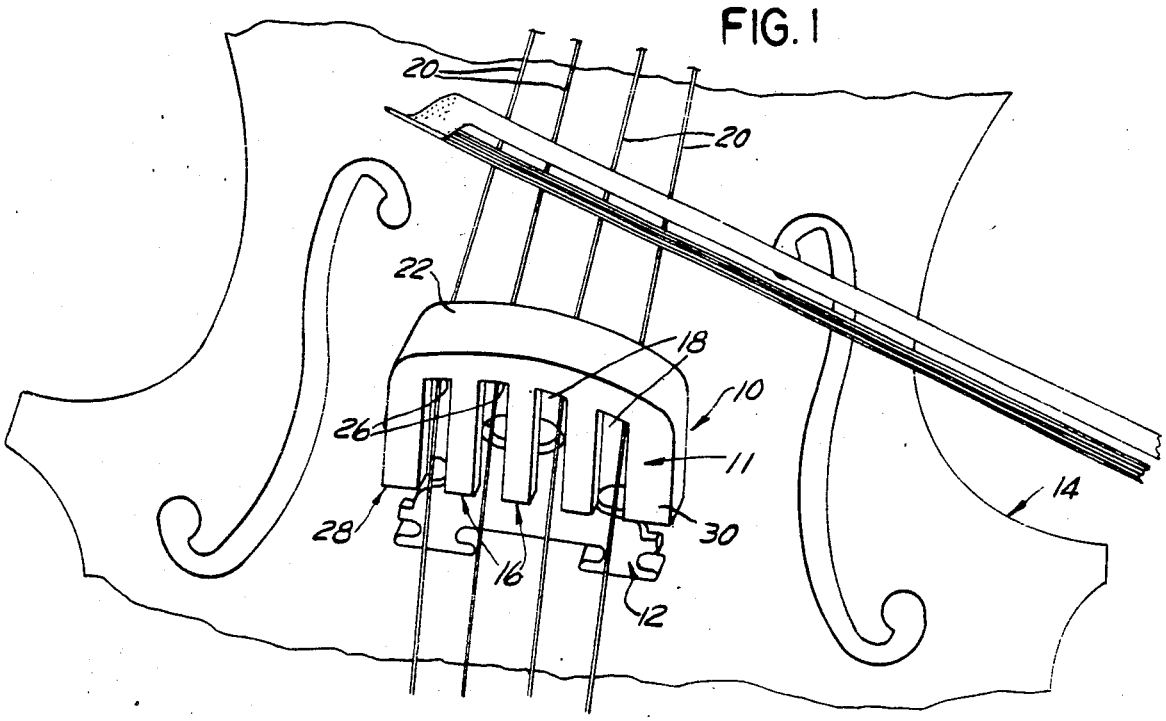
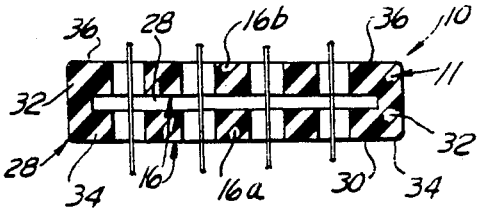
FIG. 3
FIG. 2
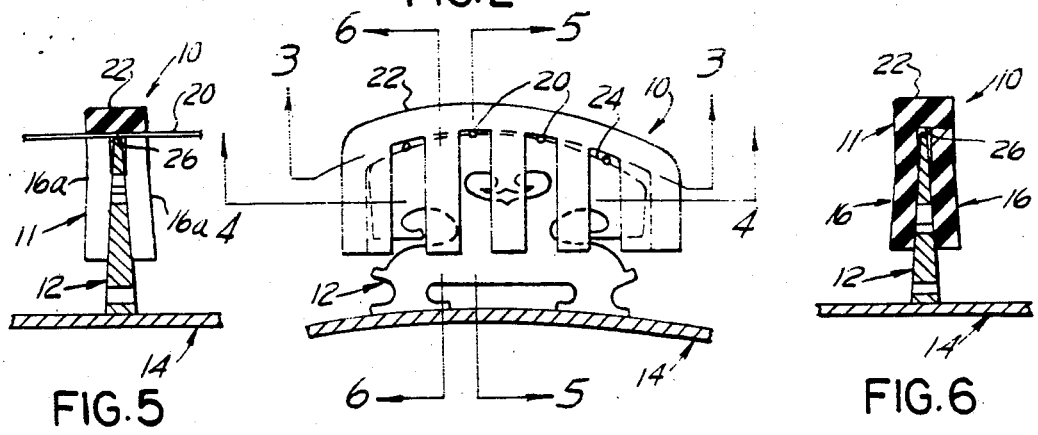
FIG. 5
FIG. 6
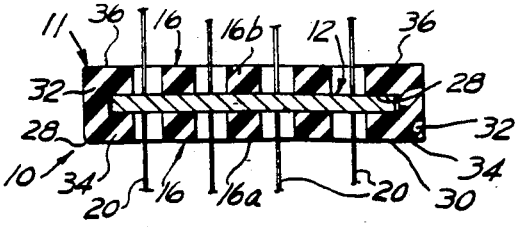
FIG. 4

MUTE FOR STRING MUSICAL INSTRUMENT

CROSS-REFERENCE TO RELATED APPLICATION

The present application is related to copending application Ser. No. 844,273, filed 3-11-86 for a design patent, filed contemporaneously herewith.

BACKGROUND OF THE INVENTION

The present invention relates to a practice mute for a string musical instrument in general, and more particularly for a bow string musical instrument such as a violin, viola, cello or bass.

Mutes for string musical instruments, such as violin, viola, cello, or bass, which produce musical tones when a bow is drawn across the strings, or when the strings are finger-plucked, are generally used to somewhat reduce the volume of the sound generated during practice or rehersal to prevent excessive sound propagation beyond a room or hall, and sometimes during performance of a musical rendition. Most mutes available at the present consist of a relatively massive metallic member which is placed over the bridge and engages a portion of the periphery of the strings such as to prevent full amplitude of vibration or oscillation of the strings. In addition, the vibrations of the bridge transmitting the sound to the instrument soundboard are dampened by the mass of the mute supported by the bridge.

Massive metallic mutes are heavy, as a relatively large mass of metal is required for deadening the sound emitted by the strings and transmitted through the bridge, and for dampening the vibrations of the strings and the bridge. The thickness of the metal in engagement with the strings and the top edge of the bridge is substantial, in order to effectively prevent resonance of the mute itself, with the result that conventional massive metallic mutes are substantially high and their top projects a distance from the top edge of the bridge which may prevent the performer from seeing the bow or the placement of the bow hair in engagement with the strings. In addition, such mutes rely on gravity to remain in position, and they may damage the strings or the bridge.

SUMMARY OF THE INVENTION

The present invention provides a mute made of sound deadening material such as a thermoplastic elastomer, which is light in weight, which is of relatively small volume, which is of relatively low profile, and has a top surface projecting only slightly beyond the top of the bridge, thus providing the performer with a clear view of his bow. The invention further provides a mute, made of sound-deadening material which is elastically and frictionally held over the bridge of a string musical instrument, which can be manufactured, preferably from thermoplastic elastomer, by molding, or even by extrusion, followed by cutting to width and slotting.

The many objects and advantages of the present invention will become apparent to those skilled in the art when the following description of the best mode contemplated at the present for practicing the invention is read in conjunction with the accompanying drawing, in which:

BRIEF DESCRIPTION OF THE DRAWINGS

FIG. 1 is a perspective view of a string musical instrument mute, according to the present invention, in position over the string bridge of a string instrument;

FIG. 2 is a front elevation view thereof;

FIG. 3 is a longitudinal section thereof substantially along line 3—3 of FIG. 2;

FIG. 4 is a longitudinal section thereof along line 4—4 of FIG. 2;

FIG. 5 is a transverse section thereof along line 5—5 of FIG. 2; and FIG. 6 is a transverse section thereof along line 6—6 of FIG. 2.

DETAILED DESCRIPTION OF THE PREFERRED EMBODIMENT

Referring to the drawing, and more particularly to FIG. 1, a mute 10 according to the present invention takes the form of a molded block 11, made preferably of a thermoplastic elastomer, which, in use, is clipped over the bridge 12 of a string musical instrument such as a violin 14, a viola, a cello or a bass, for example. The block 11 of thermoplastic elastomer has a plurality of spaced-apart fingers 16, forming a plurality of slots 18 between adjacent fingers 16, in a comb-like manner. As many slots 18 are provided as there are strings 20 stretched over the top of the bridge 12 of the string musical instrument, four for a violin, cello or bass, and six for a viola. The top surface 22 of the mute 10 is curved, has substantially the same curvature as the top edge 24, FIG. 2, of the bridge 12, and is substantially parallel to the bridge top edge 24. The thickness of the material between the surface 26 at the closed end of each slot 18 and the curved top surface 22 of the bridge 12 is thus substantially constant from one slot 18 to the next. A longitudinal narrow slot 28 is disposed substantially along the centerline of the block 11. The slot 28 extends from the tip of the fingers 16 to the surface 26, such that each finger 16 is bifurcated, as best shown at FIGS. 3–6, such that a space or gap, due to the longitudinal slot 28 is formed between two corresponding bifurcated portions **16*a* and 16*b* of each finger 16. The width of the longitudinal slot 28, more particularly at the bottom of the fingers 16, is slightly less than the maximum width of the bridge 12, the slot 28 being, for example, substantially of the same width as the bridge 12 at its top. The bridge 12** is tapered from bottom to top, the taper angle being generally of the order of a four-degree included angle for a violin bridge.

When placed in position over the string musical instrument bridge 12, as illustrated in the drawing, the surface 26 at the end of the slots 18 is pressed down until it engages at least a portion of the surface of the bridge top edge 24, being thus resiliently engaged with a length of the strings 20 on one side and the other of the bridge 12. As the bifurcated finger portions **16*a* and 16*b* are elastically deflected outwardly apart from each other, more particularly at their bottom tip, the mute block 11 is clipped over the bridge 12 and held frictionally thereon by elastic deformation of the leg portions 16*a* and 16*b***.

In addition, end fingers 29 and 30 are each formed at an end of the block 11. As shown more clearly at FIGS. 3 and 4, the end fingers 28 and 30 are U-shaped in cross-section, as a result of the longitudinal slot 29 extending part of the way, each end finger 29 or 30 being provided with an end wall 32 and two opposite sidewalls 34 and 36 integrally formed with the end wall 32. The end wall 32 of each end finger 29 or 30 acts as an elastic integral connecting member between the sidewalls 34 and 36, and elastically prevents the sidewall 34 and 36 of each end finger 29 and 30 from being excessively split apart. Wherefore, even a stronger grip on the lateral edges or on the surfaces proximate the lateral edges of the bridge 12 is provided by the end fingers 29 and 30, thus effectively retaining the mute 10 clipped over the bridge 12.

It will be readily appreciated by those skilled in the art that, due to the strong sound-deadening effect and the dampening action of the elastomeric material of which the mute 10 of the invention is made, the mute block 11 itself is not set in vibration, as would be the case if the mute was made of metal or of rigid plastic. Vibrations of the bridge 12, as well as excessive amplitude of oscillations of the strings 20 stretched over the top edge 24 of the bridge 12, are substantially attenuated and dampened, as a result of the elastic surface 26 engaging a portion of the periphery of each string 20, as long as the bridge block 11 is firmly installed over the bridge 12. The distance between the surface 26 and the top surface 22 of the block is relatively narrow, preferably 5–6 mm, or less, such that the mute 10 projects very little above the bridge top edge 24.

Preferably, the mute 10 is an injection molding of black rubber or of a thermoplastic elastomer, such as a styrene elastomer block copolymers, polyurethane and polyester polyether block copolymers, polyolefin blends, or the like. A convenient material is the polyester elastomer sold by E. I. Du Pont de Nemours & Co. under the trademarks HYTREL and KELDAX, and the thermoplastic rubber sold under the trademark KRATON G-7150 by Shell Chemical Co. Another available method of manufacturing the mute 10 is to form extrusions of a thermoplastic elastomer, cut the extrusions to lengths according to the desired thickness of the mute block 11, and subsequently forming the slot 28 and forming the separate bifurcated portions 16*a* and 16*b* of the intermediary fingers 16, and the U-shaped end fingers 29 and 30.

Having thus described the present invention by way of an example of structure and methods of manufacturing such structural example thereof, modifications whereof will be apparent to those skilled in the art.

What is claimed as new is as follows:

1. A mute for musical string instrument comprising a block of elastomeric sound-deadening material comprising a plurality of transverse slots open at an end and closed by a surface at the other end, one of said transverse slots being provided for each string of said string instrument, said transverse slots defining intermediate fingers between adjoining slots, said intermediate fingers each having a free end, and a longitudinal slot in said block defining a pair of bifurcated portions for each of said intermediate fingers, said longitudinal slot extending flush with said surface at the closed end of said transverse slots said longitudinal slot extending part of the way into end fingers formed one at each end of said block such that said end fingers are U-shaped in cross section, whereby said mute is adapted to be clipped over the bridge of the musical instrument and is elastically retained thereon with said bridge engaged in said longitudinal slot, the surface at the end of said transverse slots in engagement with at least one string.

2. The mute of claim 1 further comprising a top curved surface of said block substantially parallel to the top edge of said bridge.

3. The mute of claim 1 further comprising a top curved surface for said block substantially parallel to the top edge of said bridge.

4. A mute for a musical string instrument having a soundboard and a bridge in engagement with said soundboard for transmitting sound from strings stretched over the edge of said bridge when said strings are set in vibration, said mute comprising a block of sound-deadening material having a longitudinal slot of a width slightly less than the thickness of said bridge, and a transverse slot for each string of said instrument, whereby said block is clipped over said bridge and held resiliently thereover, each of said transverse slots having a closed end forming a surface engageable with said edge of said bridge said longitudinal slot being closed at both ends such as to form a pair of end fingers each substantially U-shaped in section and elastically engaging said bridge at each end thereof.

5. The mute of claim 4 wherein said sound-deadening material is an elastomeric material.

6. The mute of claim 5 wherein the elastomeric material is a thermoplastic elastomer.

7. The mute of claim 4 wherein said transverse slots define fingers therebetween and said longitudinal slot is disposed substantially at the centerline of said block such that said fingers are bifurcated and each bifurcated portion has substantially the same thickness as the opposite bifurcated portion.

8. The mute of claim 4 wherein said block has a curvilinear top surface substantially parallel to said edge of said bridge and disposed at a relatively short distance from said edge of said bridge.

* * * * *